US011368774B1

(12) United States Patent
Lee

(10) Patent No.: US 11,368,774 B1
(45) Date of Patent: Jun. 21, 2022

(54) EAR TIP INCLUDING COMFORTABLE WEARING STRUCTURE

(71) Applicant: AZLA Inc., Seoul (KR)

(72) Inventor: Sang Won Lee, Seoul (KR)

(73) Assignee: AZLA Inc., Seoul (KR)

( * ) Notice: Subject to any disclaimer, the term of this patent is extended or adjusted under 35 U.S.C. 154(b) by 0 days.

(21) Appl. No.: 17/668,669

(22) Filed: Feb. 10, 2022

(30) Foreign Application Priority Data

Feb. 16, 2021 (KR) ..... 10-2021-0020596

(51) Int. Cl.
*H04R 1/10* (2006.01)

(52) U.S. Cl.
CPC ..... *H04R 1/1016* (2013.01); *H04R 1/1025* (2013.01); *H04R 1/1041* (2013.01)

(58) Field of Classification Search
CPC ... H04R 1/1016; H04R 1/1025; H04R 1/1041
See application file for complete search history.

(56) References Cited

U.S. PATENT DOCUMENTS

| | | | | |
|---|---|---|---|---|
| 10,506,320 | B1 * | 12/2019 | Lott | H04R 1/1091 |
| 2010/0002900 | A1 * | 1/2010 | Cohen | H02K 33/16 381/396 |
| 2010/0008521 | A1 * | 1/2010 | Cohen | H04R 1/227 381/98 |
| 2012/0076330 | A1 * | 3/2012 | Cohen | H04R 1/005 381/396 |

FOREIGN PATENT DOCUMENTS

| | | |
|---|---|---|
| KR | 10-1191989 B1 | 10/2012 |
| KR | 10-1960789 B1 | 3/2019 |

* cited by examiner

*Primary Examiner* — Simon King
(74) *Attorney, Agent, or Firm* — Fay Sharpe LLP

(57) ABSTRACT

Disclosed is an ear tip including a comfortable wearing structure. An ear tip according to an embodiment of the present disclosure is mounted at one side of an earphone, inserted into an external auditory meatus of a wearer, and configured to stably fix a position of the earphone, and the ear tip includes: a main body part having a hollow cylinder structure corresponding to an outer peripheral surface of the earphone; an external auditory meatus contact part radially protruding from an outer peripheral surface of a lower end of the main body part, extending upward by a predetermined height, and configured to come into contact with an inner surface of the external auditory meatus of the wearer; and a pressure dispersion part mounted in a space defined by the outer peripheral surface of the main body part and an inner peripheral surface of the external auditory meatus contact part and having a plurality of hollow polygonal columns disposed adjacent to one another and extending upward from a lower surface by a predetermined height. According to the present disclosure, it is possible to provide an ear tip including a comfortable wearing structure that may eliminate discomfort caused by pressure and irritation by changing a partial pressure, which is applied to a skin surface of an external auditory meatus of a wearer by the ear tip when the wearer wears the ear tip in the wearer's ear, into a dispersion pressure and may improve an active noise canceling function by bringing the ear tip into close contact with the skin surface of the external auditory meatus of the wearer.

4 Claims, 10 Drawing Sheets

[FIG. 1]
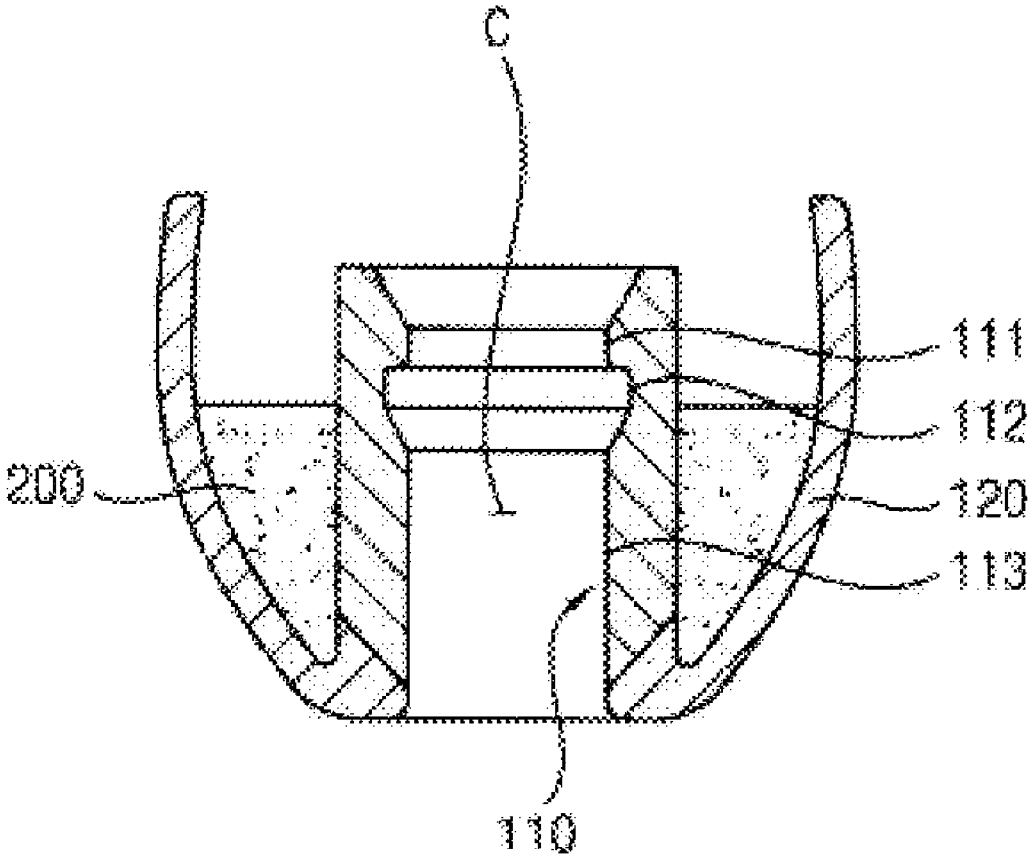

[FIG. 2]
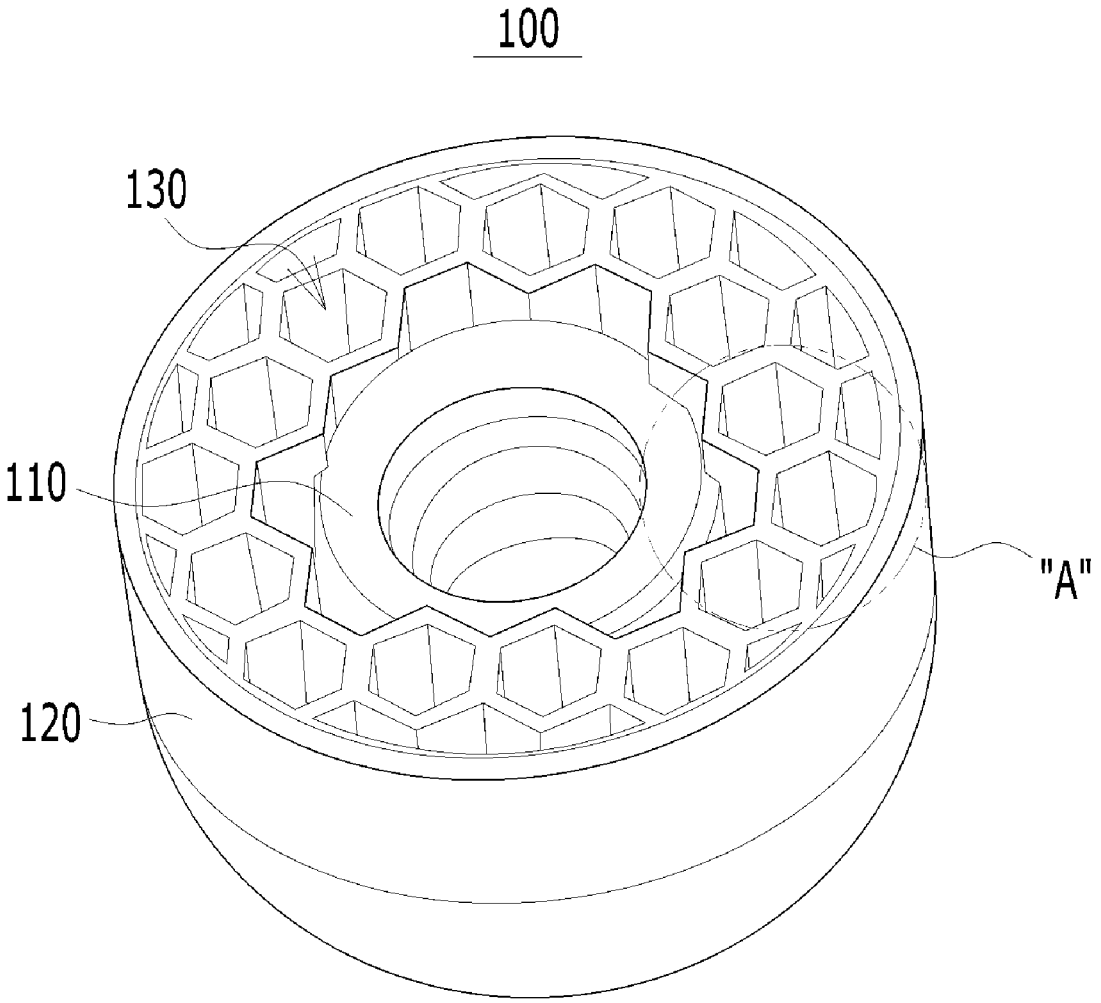

[FIG. 3]
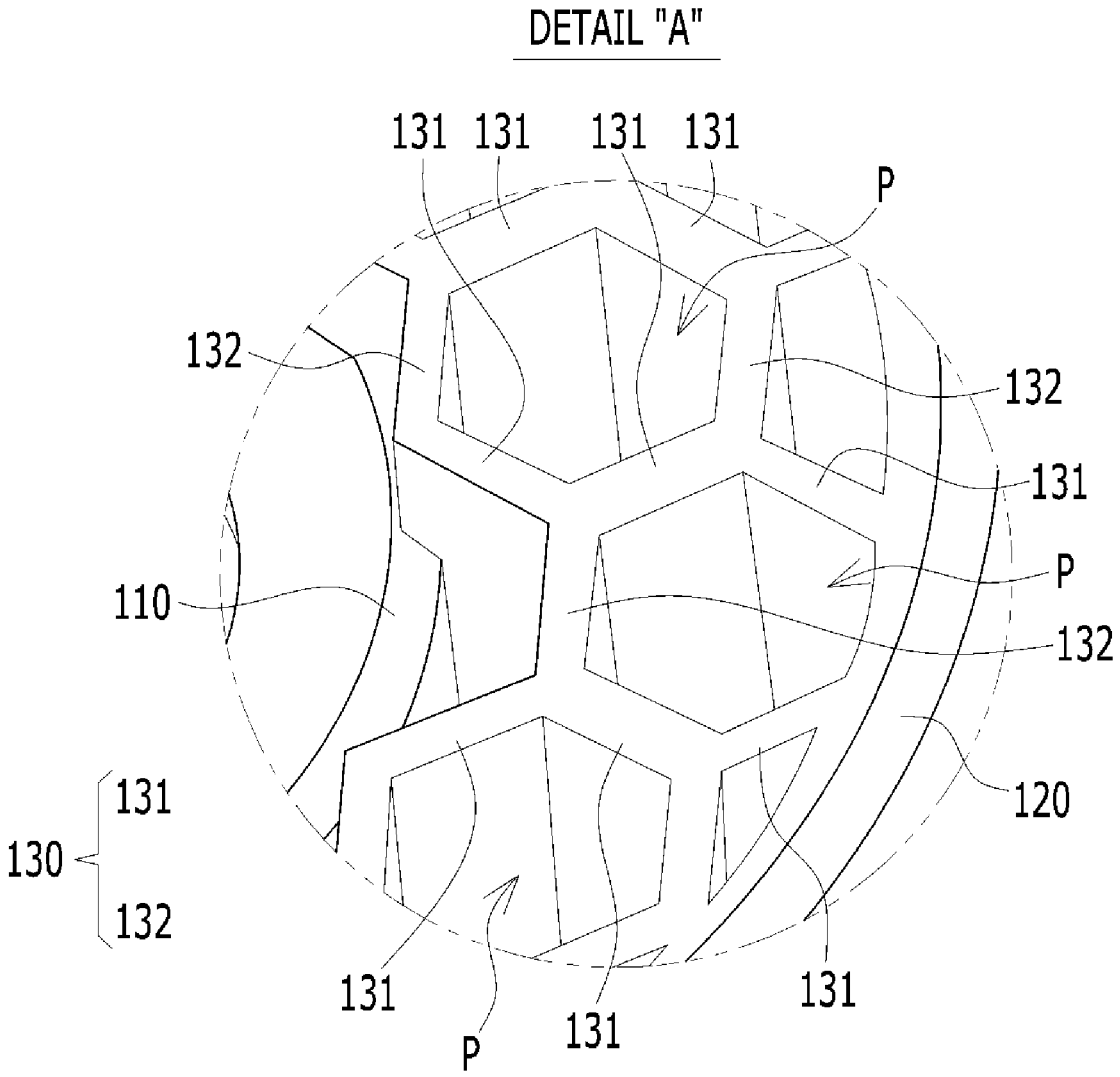

[FIG. 4]
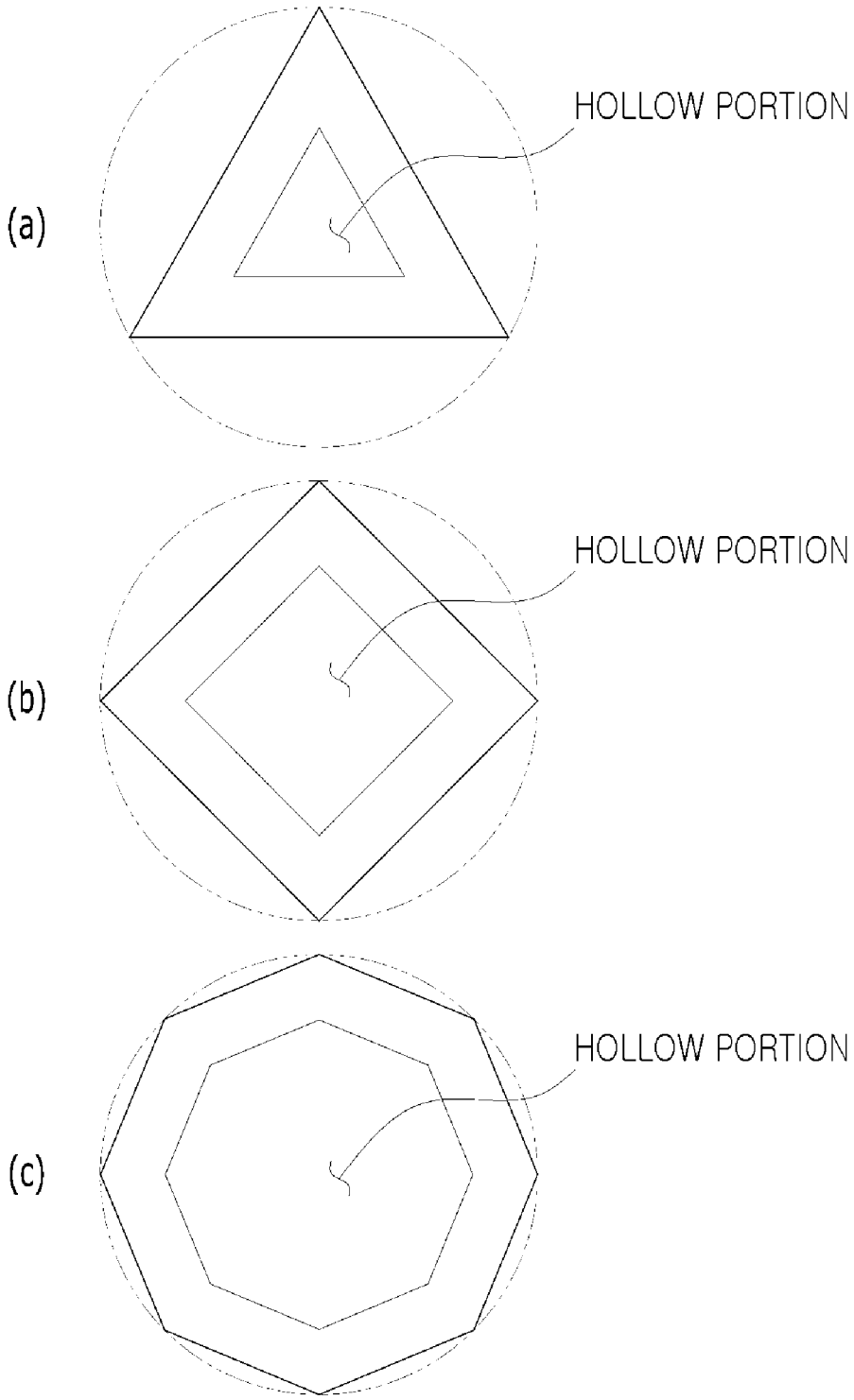

[FIG. 5]
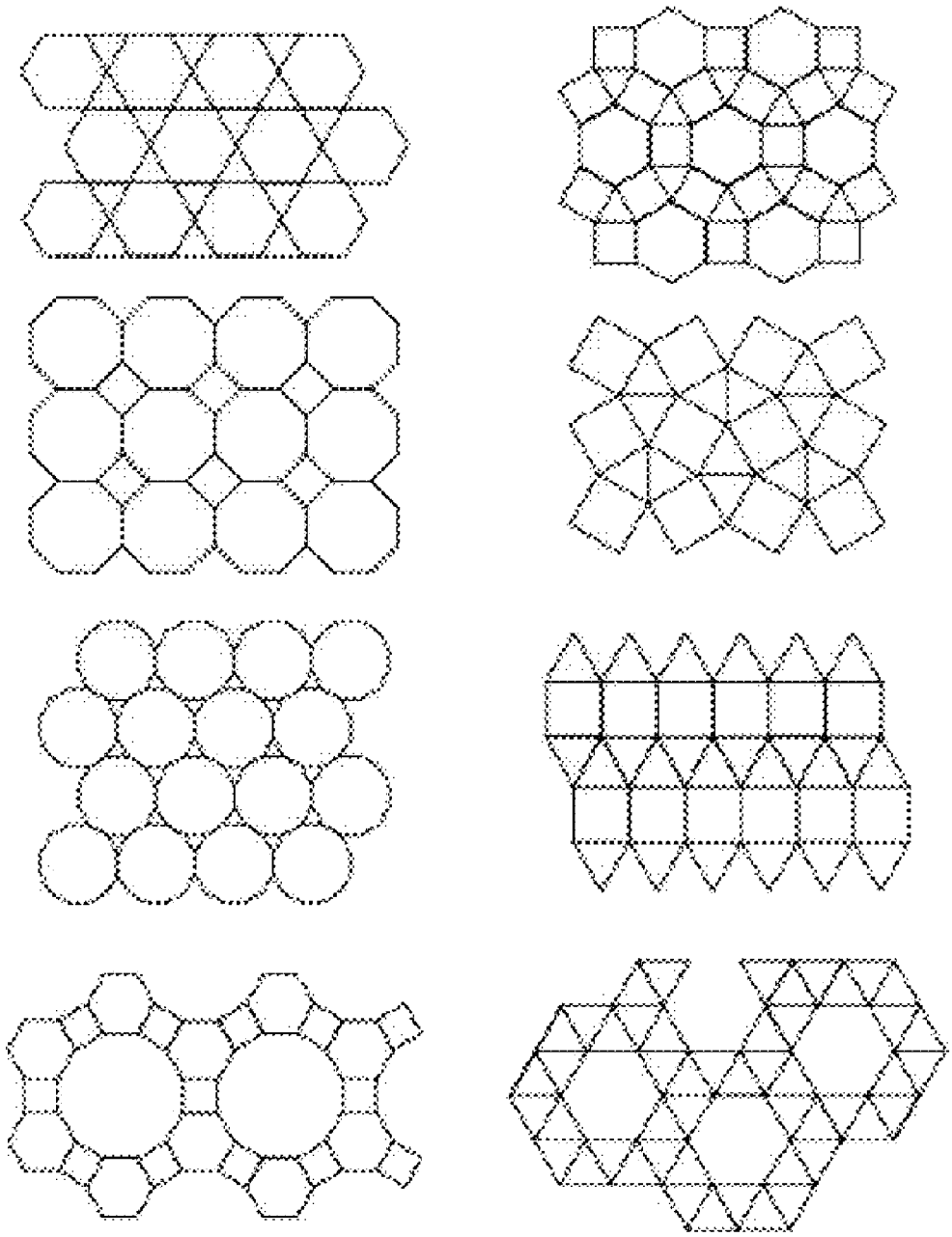

[FIG. 6]
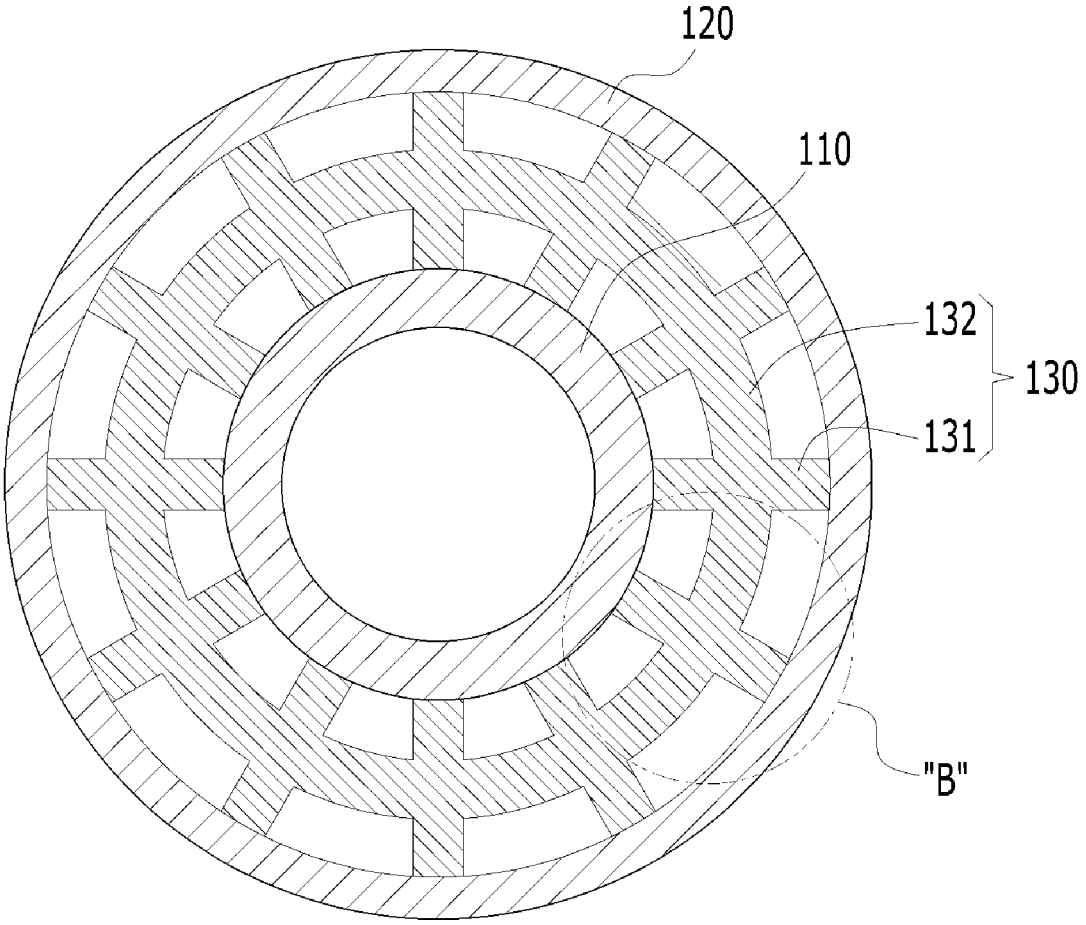

[FIG. 7]
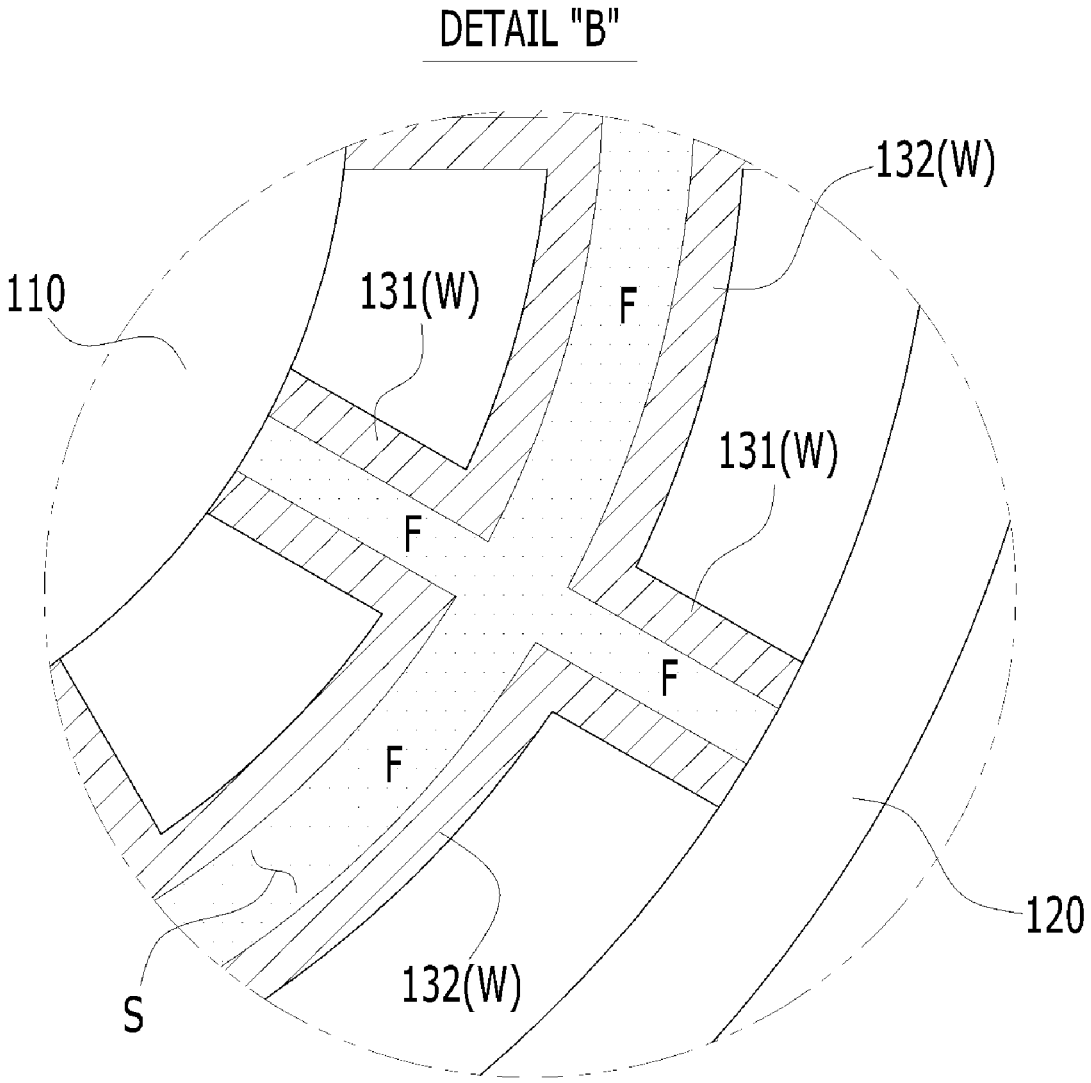

[FIG. 8]
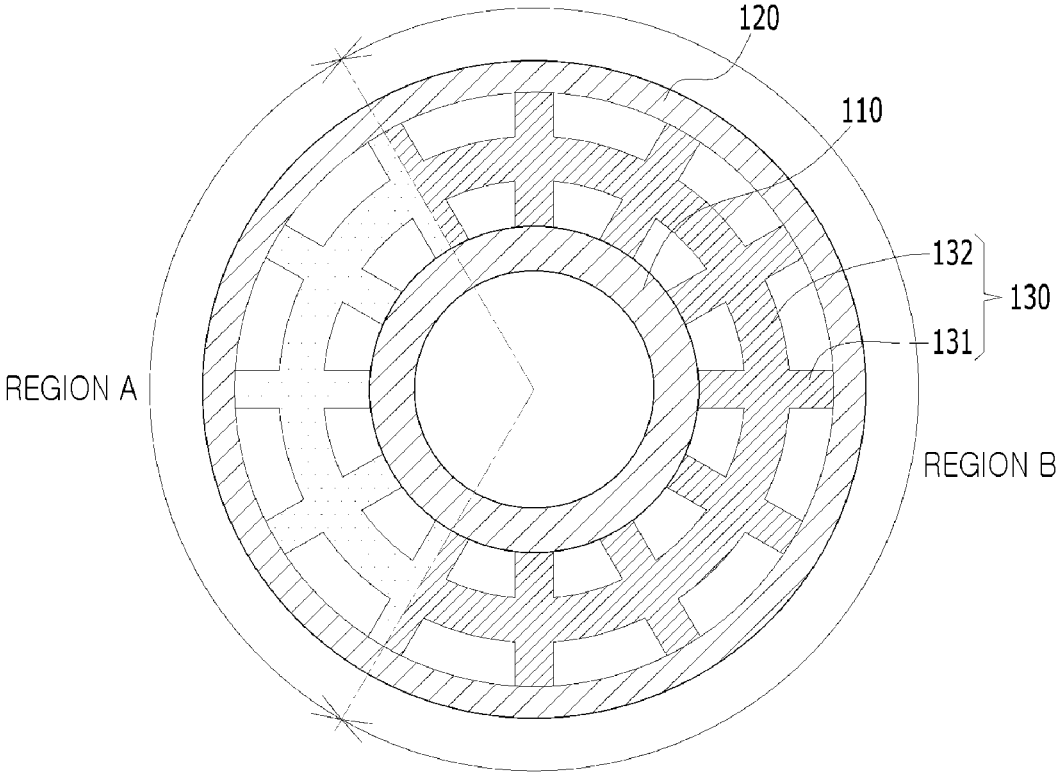

[FIG. 9]
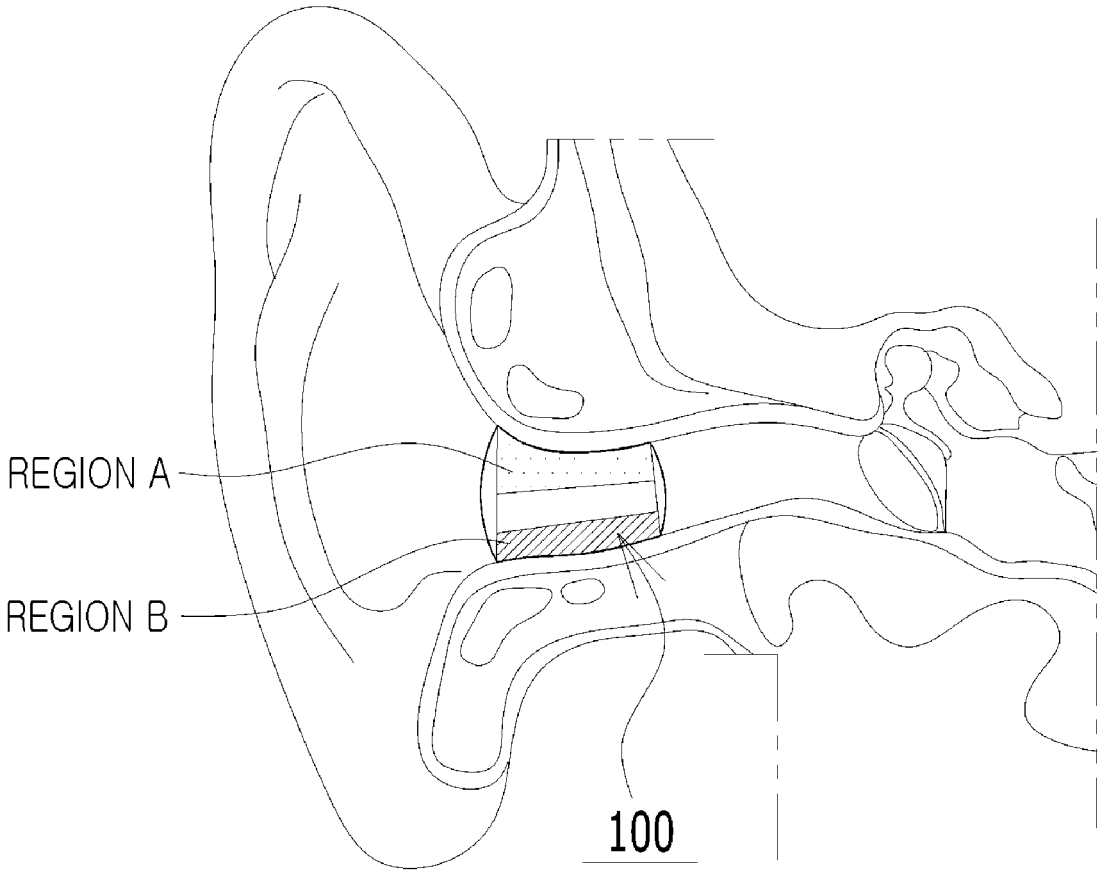

[FIG. 10]
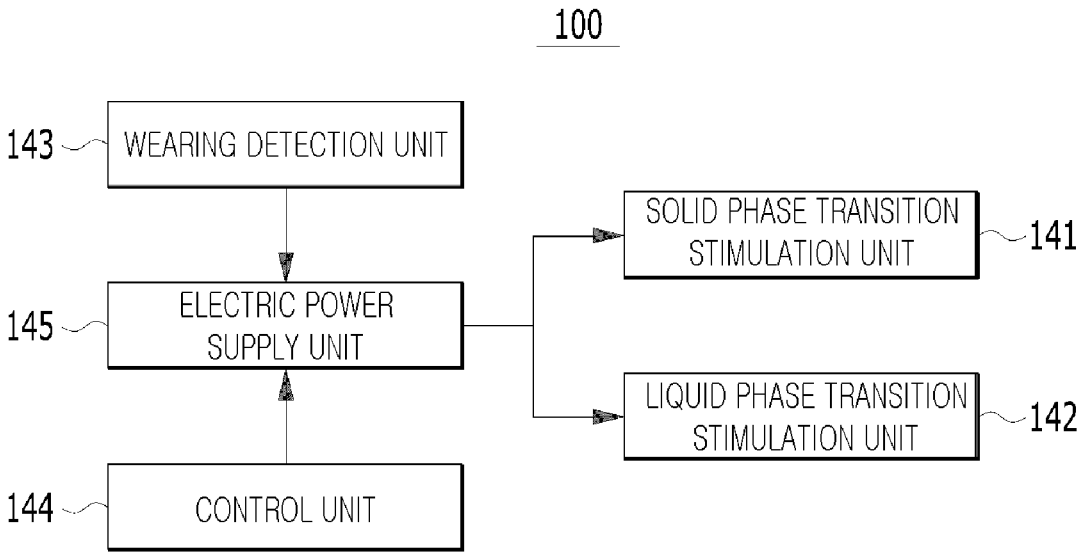

EAR TIP INCLUDING COMFORTABLE WEARING STRUCTURE

BACKGROUND

Field

The present disclosure relates to an ear tip, and more particularly, to an ear tip including a comfortable wearing structure capable of providing comfortable wearing comfort by dispersing a pressure when a wearer wears the ear tip in the wearer's ear.

Description of the Related Art

Recently, many smartphone users use typical earphones or Bluetooth earphones with hands-free functions when the users listen to music or make phone calls with smartphones.

In most cases, the smartphone comes with earphones when the user purchases the smartphone for the first time. In comparison with headphones, the earphones provide a slightly small sound volume. However, because the earphone has a small size and thus is easy to carry, the earphone has become a necessity for life along with the popular spread of smartphones.

The earphones may be broadly classified in terms of shapes into an open-type earphone and a canal-type earphone. The open-type earphones were widely used in the case of initial models, but recently, the open-type earphones and the canal-type earphones are used at a similar ratio.

The advantage of the open-type earphone is that a speaker module disposed in a housing of the earphone is not completely sealed by an earhole, the sound is not transmitted directly to the ear, and the sound partially leaks, which enables the user to feel comfortable open feeling. The canal-type earphone advantageously has an effect of blocking noise. When an ear tip matched with a width of an internal ear is mounted regardless of a shape of an external ear that varies from person to person, the ear tip comes into close contact with the ear hole well, which makes a high fixing force.

The open-type earphone and the canal-type earphone are in a complementary relationship. The canal-type earphone was created in an effort to solve the problem of a low ability of playing sound in a low sound range caused by the fixing force and sound leak and solve the problem of an inflow of external noise, which are the drawbacks of the open-type earphone. In contrast to the open-type earphone, the canal-type earphone has the fixing force and the function of blocking noise and is strong for the sound range of the low-pitched sound because the canal-type earphone is in close contact with the earhole and the air does not circulate well. However, the canal-type earphone disadvantageously causes the person to feel irritation, stuffiness, and pain.

In addition, like a hermetic headphone, the canal-type earphone minimizes external noise by bringing a speaker and the ear into maximally close contact with each other, such that sound disturbance caused by surrounding sound is low, and the sound generated by a vibration diaphragm does not leak to the outside. Therefore, the canal-type earphone is advantageous because the user may listen to music and does not damage the surrounding in a location where an external environment is poor, i.e., external noise is severe. However, in comparison with the open-type earphone, the wearing comfort of the canal-type earphone is not relatively good because of a pressure of the ear tip being in close contact with the ear when the canal-type earphone is used over a long period of time. Further, the canal-type earphone has a drawback in that because the sound of the vibration diaphragm directly affects a tympanum, the tympanum may receive impact caused by the air pressure.

To solve the problems, as illustrated in FIG. 1, a filling material 200 is inserted into an internal space of an ear tip and in close contact with an earhole. However, a pressure of the filling material rather causes discomfort in wearing an earphone.

Therefore, there is a need for a technology capable of solving the above-mentioned problems in the related art.

Document of Related Art

Patent Document (Patent Document 0001) Korean Patent No. 10-1323805 (registered on Oct. 24, 2013)

SUMMARY

An object of the present disclosure is to provide an ear tip including a comfortable wearing structure that may eliminate discomfort caused by pressure and irritation by changing a partial pressure, which is applied to a skin surface of an external auditory meatus of a wearer by the ear tip when the wearer wears the ear tip in the wearer's ear, into a dispersion pressure and may improve an active noise canceling function by bringing the ear tip into close contact with the skin surface of the external auditory meatus of the wearer.

According to an aspect of the present disclosure, there is provided an ear tip, which is mounted at one side of an earphone, inserted into an external auditory meatus of a wearer, and configured to stably fix a position of the earphone, and the ear tip including: a main body part having a hollow cylinder structure corresponding to an outer peripheral surface of the earphone; an external auditory meatus contact part radially protruding from an outer peripheral surface of a lower end of the main body part, extending upward by a predetermined height, and configured to come into contact with an inner surface of the external auditory meatus of the wearer; and a pressure dispersion part mounted in a space defined by the outer peripheral surface of the main body part and an inner peripheral surface of the external auditory meatus contact part and having a plurality of hollow polygonal columns disposed adjacent to one another and extending upward from a lower surface by a predetermined height.

In the embodiment of the present disclosure, the pressure dispersion part may include: a plurality of first sidewalls configured to connect the outer peripheral surface of the main body part and the inner peripheral surface of the external auditory meatus contact part on a single plane or a bent plane; and a plurality of second sidewalls configured to define a structure of the hollow polygonal column by connecting the plurality of first sidewalls.

In the embodiment of the present disclosure, the first and second sidewalls of the pressure dispersion part may be made of a flexible material that may be naturally deformed by a pressure of the user's finger.

In the embodiment of the present disclosure, density of the plurality of hollow polygonal columns constituting the pressure dispersion part increases in a direction from the inner peripheral surface of the external auditory meatus contact part to the outer peripheral surface of the main body part.

In the embodiment of the present disclosure, the hollow polygonal column of the pressure dispersion part may be made of a flexible material that may be naturally deformed by a pressure of the user's finger.

In this case, the sidewall of the pressure dispersion part may include: a fluid accommodation space communicating interiors of the plurality of sidewalls and having an area corresponding to an extension surface of the sidewall so as to accommodate a fluid therein; and a phase change fluid accommodated in the fluid accommodation space and configured to experience phase transition between a gel state and a solid state by external electrical stimulation.

In the embodiment of the present disclosure, the phase change fluid may include supercooled substances and nuclear particles for changing the phase of the supercooled substances, and the nuclear particles may be graphite or conductive particles mixed with the supercooled substances to transmit the electrical stimulation to the phase change fluid.

In the embodiment of the present disclosure, the main body part may include: a solid phase transition stimulation unit mounted on one surface of the main body part, including a plurality of electrodes introduced into an interior of the fluid accommodation space, and configured to apply electrical stimulation to the interior of the fluid accommodation space by being supplied with electric power from the electric power supply unit; a liquid phase transition stimulation unit mounted on one surface of the main body part, including a plurality of thermoelectric elements introduced into the fluid accommodation space, and configured to apply heat to the interior of the fluid accommodation space by being supplied with electric power from the electric power supply unit; a wearing detection unit mounted on the outer peripheral surface of the main body part and configured to detect a state in which the ear tip is in contact with the skin of the external auditory meatus of the wearer and transmit detected data to a control unit; an electric power supply unit mounted on one surface of the main body part and configured to provide electric power, which is stored in a secondary battery rechargeable in a wireless manner, to the solid phase transition stimulation unit and the liquid phase transition stimulation unit in accordance with a control signal of the control unit; and the control unit mounted on one surface of the main body part and configured to control operations of the solid phase transition stimulation unit and the liquid phase transition stimulation unit on the basis of the data detected by the wearing detection unit.

As described above, the ear tip according to the present embodiment includes the main body part having a specific structure, the external auditory meatus contact part, and the pressure dispersion part. Therefore, it is possible to provide the ear tip including a comfortable wearing structure that may eliminate discomfort caused by pressure and irritation by changing the partial pressure, which is applied to the skin surface of the external auditory meatus of the wearer by the ear tip when the wearer wears the ear tip in the wearer's ear, into the dispersion pressure and may improve the active noise canceling function by bringing the ear tip into close contact with the skin surface of the external auditory meatus of the wearer.

In addition, the ear tip according to the present embodiment has the pressure dispersion part including the first and second sidewalls having the specific structures, and the density of the plurality of hollow polygonal columns constituting the pressure dispersion part varies depending on the particular position. Therefore, it is possible to provide the ear tip including a comfortable wearing structure that may eliminate discomfort caused by pressure and irritation by changing the partial pressure, which is applied to the skin surface of the external auditory meatus of the wearer by the ear tip when the wearer wears the ear tip in the wearer's ear, into the dispersion pressure and may improve the active noise canceling function by bringing the ear tip into close contact with the skin surface of the external auditory meatus of the wearer.

In addition, according to the ear tip according to the present disclosure, the fluid accommodation space having the specific structure is formed in the sidewalls constituting the pressure dispersion part, and the interior of the fluid accommodation space is filled with the phase change fluid, such that the flexibility of the sidewalls constituting the pressure dispersion part may be changed in some instances, and the wearing comfort of the ear tip may be adjusted in accordance with the user's preference. The user may bring the ear tip into close contact with the external auditory meatus and fix the ear tip by changing the flexibility of the pressure dispersion part after the user wears the ear tip in the user's external auditory meatus. Therefore, it is possible to provide the ear tip including a comfortable wearing structure capable of improving an active noise canceling function by bringing the ear tip into close contact with the skin surface of the external auditory meatus of the wearer.

In addition, according to the ear tip according to the present disclosure, the solid phase transition stimulation unit, the liquid phase transition stimulation unit, the wearing detection unit, the electric power supply unit, and the control unit, which perform the specific functions, are provided, the flexibility of the sidewalls constituting the pressure dispersion part may be changed depending on whether the ear tip is worn, and the wearing comfort of the ear tip may be adjusted in accordance with the user's preference. The user may bring the ear tip into close contact with the external auditory meatus and fix the ear tip by changing the flexibility of the pressure dispersion part after the user wears the ear tip in the user's external auditory meatus. Therefore, it is possible to provide the ear tip including a comfortable wearing structure capable of improving the active noise canceling function by bringing the ear tip into close contact with the skin surface of the external auditory meatus of the wearer.

BRIEF DESCRIPTION OF THE DRAWINGS

The above and other aspects, features and other advantages of the present disclosure will be more clearly understood from the following detailed description taken in conjunction with the accompanying drawings, in which:

FIG. 1 is a cross-sectional view illustrating an ear tip in the related art;

FIG. 2 is a perspective view illustrating an ear tip according to an embodiment of the present disclosure;

FIG. 3 is an enlarged view of part A in FIG. 2;

FIG. 4 is a view illustrating various examples of bottom shapes of hollow polygonal columns that constitute a pressure dispersion part of the ear tip according to the embodiment of the present disclosure;

FIG. 5 is a view illustrating various examples in which the pressure dispersion parts are configured by combining various polygons including the bottom shapes illustrated in FIG. 4;

FIG. 6 is a top plan view illustrating an ear tip according to another embodiment of the present disclosure;

FIG. 7 is an enlarged view of part B in FIG. 6;

FIG. 8 is a top plan view illustrating an ear tip according to still another embodiment of the present disclosure;

FIG. 9 is a schematic view illustrating a state in which the ear tip illustrated in FIG. 8 is worn in an external auditory meatus of a wearer; and FIG. 10 is a configuration view illustrating an ear tip according to yet another embodiment of the present disclosure.

DETAILED DESCRIPTION OF THE EMBODIMENT

Hereinafter, exemplary embodiments of the present disclosure will be described in detail with reference to the drawings. Terms or words used in the present specification and the claims should not be interpreted as being limited to a general or dictionary meaning and should be interpreted as a meaning and a concept which conform to the technical spirit of the present disclosure.

Throughout the specification of the present application, when one member is disposed "on" another member, this includes not only a case where the one member is brought into contact with another member, but also a case where still another member is present between the two members. Throughout the specification of the present application, unless explicitly described to the contrary, the word "comprise" or "include" and variations, such as "comprises", "comprising", "includes" or "including", will be understood to imply the inclusion of stated constituent elements, not the exclusion of any other constituent elements.

FIG. 2 is a perspective view illustrating an ear tip according to an embodiment of the present disclosure, and FIG. 3 is an enlarged view of part A in FIG. 2.

Referring to the drawings, an ear tip 100 according to the present embodiment includes a main body part 110 having a specific structure, an external auditory meatus contact part 120, and a pressure dispersion part 130. Therefore, it is possible to provide an ear tip including a comfortable wearing structure that may eliminate discomfort caused by pressure and irritation by changing a partial pressure, which is applied to a skin surface of an external auditory meatus of a wearer by the ear tip when the wearer wears the ear tip in the wearer's ear, into a dispersion pressure and may improve an active noise canceling function by bringing the ear tip into close contact with the skin surface of the external auditory meatus of the wearer.

Hereinafter, respective components constituting the ear tip 100 according to the present embodiment will be described in detail with reference to the drawings.

The ear tip 100 according to the present embodiment has a structure mounted at one side of an earphone and inserted into an external auditory meatus of a wearer to stably fix a position of the earphone. The ear tip 100 includes the main body part 110 having a specific structure, the external auditory meatus contact part 120, and the pressure dispersion part 130.

The main body part 110 of the ear tip 100 according to the present embodiment has a hollow cylinder structure corresponding to an outer peripheral surface of the earphone and includes a structure fastened to an outer peripheral surface of one side of the earphone.

The external auditory canal contact part 120 has a structure radially protruding from an outer peripheral surface of a lower end of the main body part 110 and extending upward by a predetermined height and is configured to come into contact with the inner surface of the external auditory canal of the wearer.

In addition, the pressure dispersion part 130 according to the present embodiment is mounted in a space defined by the outer peripheral surface of the main body part 110 and an inner peripheral surface of the external auditory meatus contact part 120. The pressure dispersion part 130 may have a structure in which a plurality of hollow polygonal columns P extending upward from the lower surface by a predetermined height is disposed adjacent to one another.

As illustrated in FIG. 3, the pressure dispersion part 130 according to the present embodiment includes first and second sidewalls 131 and 132 having specific structures and disposed at particular positions.

Specifically, the first sidewall 131 connects the outer peripheral surface of the main body part 110 and the inner peripheral surface of the external auditory meatus contact part 120 on a single plane or a bent plane. As illustrated in FIGS. 2 and 3, the first sidewall 131 may be provided in plural.

The second sidewall 132 connects the plurality of first sidewalls 131 to define the structure of the hollow polygonal column P. As illustrated in FIGS. 2 and 3, the second sidewall 132 may be provided in plural.

The first and second sidewalls 131 and 132 of the pressure dispersion part 130 according to the present embodiment may be made of a flexible material that may be naturally deformed by a pressure of the user's finger.

In some instances, the density of the plurality of hollow polygonal columns P constituting the pressure dispersion part 130 may increase in a direction from the inner peripheral surface of the external auditory meatus contact part 120 to the outer peripheral surface of the main body part 110.

In this case, the ear tip 100 according to the present embodiment has the pressure dispersion part including the first and second sidewalls 131 and 132 having the specific structures, and the density of the plurality of hollow polygonal columns P constituting the pressure dispersion part varies depending on the particular position. Therefore, it is possible to provide the ear tip including a comfortable wearing structure that may eliminate discomfort caused by pressure and irritation by changing a partial pressure, which is applied to the skin surface of the external auditory meatus of the wearer by the ear tip when the wearer wears the ear tip in the wearer's ear, into a dispersion pressure and may improve an active noise canceling function by bringing the ear tip into close contact with the skin surface of the external auditory meatus of the wearer.

FIG. 4 is a view illustrating various examples of bottom shapes of hollow polygonal columns that constitute the pressure dispersion part of the ear tip according to the embodiment of the present disclosure, and FIG. 5 is a view illustrating various examples in which the pressure dispersion parts are configured by combining various polygons including the bottom shapes illustrated in FIG. 4.

Referring to these drawings and FIG. 3, the hollow polygonal column P of the pressure dispersion part 130 according to the present embodiment may be defined by the plurality of sidewalls W made of a flexible material that may be naturally deformed by a pressure of the user's finger.

A bottom surface of the hollow polygonal column P of the pressure dispersion part 130 according to the present embodiment may have a regular polygonal structure having a central hollow portion, as illustrated in FIG. 4. The pressure dispersion part 130 according to the present embodiment may be formed by a combination of the plurality of hollow polygonal columns P that has the bottom surfaces having various regular polygonal shapes illustrated in FIG. 4. In some instances, the pressure dispersion part 130 may be configured by a combination of various polygons illustrated in FIG. 5.

In the various examples illustrated in FIG. 5, the portions where the density of the polygonal columns is relatively high are disposed at the particular positions, and the portions where the density of the polygonal columns is relatively low are disposed at the remaining positions, such that the flexibility of the ear tip 100 may be adjusted.

In this case, a manufacturer may manufacture the ear tip 100 having various flexibilities or strengths in accordance with a consumer's requirement or manufacture the ear tip 100 having the flexibility or strength that varies depending on the particular position of the ear tip. When the flexibility or strength varies depending on the particular position of the ear tip, the wearing comfort, which is determined when the ear tip is worn on the skin in the external auditory meatus, varies. In this case, the consumer may purchase the ear tip manufactured in accordance with his/her preference. Consequently, the ear tip 100 according to the present embodiment may have ear tip structures that may implement various types of wearing comfort by varying the flexibility depending on the particular positions in accordance with the consumer's various requirements.

FIG. 6 is a top plan view illustrating an ear tip according to another embodiment of the present disclosure, and FIG. 7 is an enlarged view of part B in FIG. 6. In addition, FIG. 8 is a top plan view illustrating an ear tip according to still another embodiment of the present disclosure, FIG. 9 is a schematic view illustrating a state in which the ear tip illustrated in FIG. 8 is worn in the external auditory meatus of the wearer, and FIG. 10 is a configuration view illustrating an ear tip according to yet another embodiment of the present disclosure.

First, referring to FIGS. 6 and 7, the sidewalls W of the pressure dispersion part 130 according to the present embodiment may define a fluid accommodation space S having a specific structure.

Specifically, the fluid accommodation space S may have a structure communicating with the interiors of the plurality of sidewalls and having an area corresponding to an extension surface of the sidewall W so as to accommodate a fluid therein.

In this case, the interior of the fluid accommodation space S may be filled with a phase change fluid F. The phase change fluid F is a substance that experiences phase transition between a gel state and a solid state by external electrical stimulation.

Specifically, the above-mentioned phase change fluid F may be a fluid containing supercooled substances and nuclear particles for changing the supercooled substances. In this case, the nuclear particles may be graphite or conductive particles mixed with the supercooled substances to transmit the electrical stimulation to the phase change fluid F.

As illustrated in FIG. 10, the ear tip 100 according to the present embodiment may include a solid phase transition stimulation unit 141, a liquid phase transition stimulation unit 142, a wearing detection unit 143, an electric power supply unit 144, and a control unit 145 that perform specific functions.

Specifically, the solid phase transition stimulation unit 141 may be mounted on one surface of the main body part 110, include a plurality of electrodes introduced into the fluid accommodation space S, and apply electrical stimulation to the interior of the fluid accommodation space S by being supplied with electric power from the electric power supply unit 144.

The liquid phase transition stimulation unit 142 may be mounted on one surface of the main body part 110, include a plurality of thermoelectric elements introduced into the interior of the fluid accommodation space S, apply heat to the interior of the fluid accommodation space S by being supplied with electric power from the electric power supply unit 144.

The wearing detection unit 143 may be mounted on the outer peripheral surface of the main body part 110, detect a state in which the ear tip is in contact with the skin of the external auditory meatus of the wearer, and transmit the detected data to the control unit 145.

The electric power supply unit 144 is mounted on one surface of the main body part 110 and includes a secondary battery that is rechargeable in a wireless manner. The electric power supply unit 144 may provide the stored electric power to the solid phase transition stimulation unit 141 and the liquid phase transition stimulation unit 142 on the basis of a control signal of the control unit 145.

The control unit 145 is mounted on one surface of the main body part 110 and includes a secondary battery that is rechargeable in a wireless manner. The control unit 145 may provide the stored electric power to the solid phase transition stimulation unit 141 and the liquid phase transition stimulation unit 142 on the basis of a control signal of the control unit 145.

In some instances, as illustrated in FIG. 8, the phase change fluid F, which is changed in phase by the solid phase transition stimulation unit 141 and the liquid phase transition stimulation unit 142, may be disposed at the particular position. In this case, as illustrated in FIG. 9, only the portion, which is in contact with the particular position of the external auditory meatus, may change to the solid phase or the liquid phase, by providing various types of wearing comfort.

In particular, the user may change the disposition of the phase change fluid F, such that the user may change the wearing comfort in accordance with the user's convenience and preference.

Therefore, according to the ear tip 100 according to the present embodiment, the fluid accommodation space S having the specific structure is formed in the sidewalls constituting the pressure dispersion part 130, and the interior of the fluid accommodation space S is filled with the phase change fluid F, such that the flexibility of the sidewalls constituting the pressure dispersion part 130 may be changed in some instances, and the wearing comfort of the ear tip may be adjusted in accordance with the user's preference. The user may bring the ear tip into close contact with the external auditory meatus and fix the ear tip by changing the flexibility of the pressure dispersion part 130 after the user wears the ear tip in the user's external auditory meatus. Therefore, it is possible to provide the ear tip including a comfortable wearing structure capable of improving an active noise canceling function by bringing the ear tip into close contact with the skin surface of the external auditory meatus of the wearer.

In addition, according to the present embodiment, the solid phase transition stimulation unit 141, the liquid phase transition stimulation unit 142, the wearing detection unit 143, the electric power supply unit 144, and the control unit 145, which perform the specific functions, are provided, and the flexibility of the sidewalls constituting the pressure dispersion part 130 may be changed depending on whether the ear tip is worn, such that the wearing comfort of the ear tip may be adjusted in accordance with the user's preference. The user may bring the ear tip into close contact with the external auditory meatus and fix the ear tip by changing the flexibility of the pressure dispersion part 130 after the user wears the ear tip in the user's external auditory meatus.

Therefore, it is possible to provide the ear tip including a comfortable wearing structure capable of improving an active noise canceling function by bringing the ear tip into close contact with the skin surface of the external auditory meatus of the wearer.

Only the specific exemplary embodiments have been disclosed in the above-mentioned detailed description of the present disclosure. However, it should be understood that the present disclosure is not limited to the specific forms mentioned in the detailed description, but rather, it should be understood that the present disclosure includes all modifications, equivalents, and substitutes within the spirit and scope of the present disclosure defined by the appended claims.

That is, the present disclosure is not limited to the specific exemplary embodiments and descriptions, various modifications can be made by any person skilled in the art to which the present disclosure pertains without departing from the subject matter of the present disclosure as claimed in the claims, and the modifications are within the scope defined by the claims.

What is claimed is:

1. An ear tip, which is mounted at one side of an earphone, inserted into an external auditory meatus of a wearer, and configured to stably fix a position of the earphone, the ear tip comprising:

a main body part (110) having a hollow cylinder structure corresponding to an outer peripheral surface of the earphone;

an external auditory meatus contact part (120) radially protruding from an outer peripheral surface of a lower end of the main body part (110), extending upward by a predetermined height, and configured to come into contact with an inner surface of the external auditory meatus of the wearer; and a pressure dispersion part (130) mounted in a space defined by the outer peripheral surface of the main body part (110) and an inner peripheral surface of the external auditory meatus contact part (120) and having a plurality of hollow polygonal columns P disposed adjacent to one another and extending upward from a lower surface by a predetermined height, wherein the pressure dispersion part (130) is made of a flexible material that is naturally deformable by a pressure of a user's finger, and wherein the pressure dispersion part (130) comprises:

a plurality of first sidewalls (131) configured to connect the outer peripheral surface of the main body part (110) and the inner peripheral surface of the external auditory meatus contact part (120) on a single plane or a bent plane; and a plurality of second sidewalls (132) configured to define a structure of the hollow polygonal column P by connecting the plurality of first sidewalls (131).

2. The ear tip of claim 1, wherein density of the plurality of hollow polygonal columns P constituting the pressure dispersion part (130) increases in a direction from the inner peripheral surface of the external auditory meatus contact part (120) to the outer peripheral surface of the main body part (110).

3. The ear tip of claim 1, wherein the sidewall W of the pressure dispersion part (130) comprises:

a fluid accommodation space S communicating interiors of the plurality of sidewalls and having an area corresponding to an extension surface of the sidewall W so as to accommodate a fluid therein; and a phase change fluid F accommodated in the fluid accommodation space S and configured to experience phase transition between a gel state and a solid state by external electrical stimulation.

4. The ear tip of claim 3, wherein the main body part (110) comprises:

a solid phase transition stimulation unit (141) mounted on one surface of the main body part (110), including a plurality of electrodes introduced into an interior of the fluid accommodation space S, and configured to apply electrical stimulation to the interior of the fluid accommodation space S by being supplied with electric power from the electric power supply unit (144);

a liquid phase transition stimulation unit (142) mounted on one surface of the main body part (110), including a plurality of thermoelectric elements introduced into the fluid accommodation space S, and configured to apply heat to the interior of the fluid accommodation space S by being supplied with electric power from the electric power supply unit (144);

a wearing detection unit (143) mounted on the outer peripheral surface of the main body part (110) and configured to detect a state in which the ear tip is in contact with the skin of the external auditory meatus of the wearer and transmit detected data to a control unit (145);

an electric power supply unit (144) mounted on one surface of the main body part (110) and configured to provide electric power, which is stored in a secondary battery rechargeable in a wireless manner, to the solid phase transition stimulation unit (141) and the liquid phase transition stimulation unit (142) in accordance with a control signal of the control unit (145); and the control unit (145) mounted on one surface of the main body part (110) and configured to control operations of the solid phase transition stimulation unit (141) and the liquid phase transition stimulation unit (142) on the basis of the data detected by the wearing detection unit (143).

* * * * *